United States Patent [19]

Thomas, Jr. et al.

[11] 4,022,392

[45] May 10, 1977

[54] APPARATUS FOR REMOVING PACKAGES FROM TEXTILE YARN WINDER

[75] Inventors: William A. Thomas, Jr., Blacksburg, Va.; James C. Baugh, Jr., Kingsport, Tenn.

[73] Assignee: Eastman Kodak Company, Rochester, N.Y.

[22] Filed: Dec. 18, 1975

[21] Appl. No.: 641,789

[52] U.S. Cl. ..... 242/41; 57/52; 242/18 DD; 242/35.5 A; 242/46.4

[51] Int. Cl.[2] ..... B65H 67/00

[58] Field of Search ..... 242/41, 18 DD, 18 R, 242/35.5 R, 46.2, 46.3, 46.4, 46.5, 35.5 A; 57/52, 53

[56] References Cited

UNITED STATES PATENTS 3,964,723 6/1976 Schippers et al. ..... 242/35.5 A

*Primary Examiner*—Stanley N. Gilreath
*Attorney, Agent, or Firm*—D. B. Reece, III; Malcolm G. Dunn

[57] ABSTRACT

Apparatus for assisting an operator in doffing a yarn package from a textile winder, the yarn being wound on a hollow tube; the hollow tube in turn being mounted on and rotatively locked on a winding mandrel of the winder and having an end portion of the tube extending axially outwardly of the end of the winding mandrel. The apparatus comprises an abutting member for insertion within the extending tube end portion for abutment against the winding mandrel end and a series of gripping members concentric with the abutting member and actuatable for expanding radially outwardly into gripping engagement with the inside surface of the tube end portion. Upon being actuated into gripping engagement, the gripping members are caused to be rotated forcing the yarn package into counterclockwise (as viewed from the front of the winder) rotation relative to the winding mandrel to release the yarn package from its rotatively locked position on the mandrel, and as the gripping members and yarn package are being rotated, either the abutting member is or the engaged gripping members are caused to move in an axial direction relative to the other for withdrawing the yarn package from the mandrel. In one embodiment the abutting member is caused to be moved forcing the gripped tube into retraction from the mandrel; and in the second embodiment the gripping members move in retraction from the mandrel relative to the stationary abutting member.

5 Claims, 2 Drawing Figures

APPARATUS FOR REMOVING PACKAGES FROM TEXTILE YARN WINDER

BACKGROUND OF THE INVENTION

The present invention is directed to an apparatus for removing or doffing a yarn package from a textile winder, and particularly to a doffing apparatus for providing mechanical assistance to an operator for removing from textile yarn winders heavy yarn packages weighing 13 to 25 pounds and higher.

An object of the invention is to provide a tool or apparatus to assist an operator in removing packages of fairly sizeable weight, such as 13 to 25 pounds and higher (could also be lower), of partially oriented yarn (POY) or fully oriented yarn (FOY) from textile winders, such as from the Barmag SW4S Winder, Barmer Maschinenfabrik AG of West Germany from which a portion of a hollow tube supporting the wound yarn extends axially beyond the end of the winding mandrel. The extending end of the hollow tube is thus exposed for insertion of the tool or doffing apparatus. The hollow tube in turn is mounted on the winding mandrel of the Barmag SW4S textile winder and is rotatively locked thereon.

SUMMARY OF THE INVENTION

The invention thus concerns an apparatus for assisting an operator in doffing a yarn package from a textile winder. The yarn is wound on and is supported by a hollow tube, which in turn is mounted on the winding mandrel and is rotatively locked on the mandrel by a series of clutching members or spring-biased rollers (located at the inner and outer axial ends of the mandrel) which project tangentially, radially outwardly from the surface of the winding mandrel to frictionally engage the interior wall surface or inside diameter of the hollow tube. A torsion spring (not shown) forces the rollers in a clockwise direction (as viewed from the front of the winder) up a ramp (not shown) to engage against the hollow tube inside diameter; and when the rollers are moved counterclockwise they roll down the ramp (one ramp for each roller) and disengage from the hollow tube inside diameter. An end portion of the hollow tube extends axially outwardly beyond the end of the winding mandrel.

The doffing apparatus thus comprises an abutting member, which is adapted to be inserted within the projecting end portion of the hollow tube and to be axially aligned with and placed in abutment against the end of the mandrel; and concentric with the abutting member a series of gripping members, which are also at the same time inserted within the outwardly extending portion of the hollow tube and are actuatable for expanding radially outwardly into gripping engagement with the inside surface of the tube end portion. The gripping members in their engaged condition are then caused to rotate as a unit along with the hollow tube counterclockwise (as viewed from the front of the winder) relative to the winding mandrel (forcing the clutching members or rollers against their spring-bias in retraction down their respective ramps into a disengaged position) to release the hollow tube from its rotatively locked position on the winding mandrel. As the gripping members and hollow tube are being rotated, either the abutting member is or the engaged gripping members are caused to move in an axial linear direction relative to the other for withdrawing the hollow tube, which has yarn wound thereon, from the mandrel.

In one embodiment of the invention the abutting member may move axially linearly relative to the gripping members, thereby forcing the gripping members and the gripped tube and yarn to retract from the mandrel. In other words, the abutting member telescopically extends linearly axially beyond the gripping members, but since it is already in abutment with the end of the winding mandrel, the gripping members and gripped package tube are forced into retraction from the mandrel in a direction opposite to the movement of the abutting member.

In another embodiment of the inventon the abutting member remains stationary in abutment against the end of the winding mandrel while the gripping members move in retraction from the mandrel end, carrying with the gripping members the yarn package tube.

In each embodiment, the gripping members are rotated as a unit to free the package tube from its rotatively locked position on the winding mandrel, and the rotation continues while the package tube is being withdrawn from the mandrel. It is not necessary, however, to make a full 360° rotation, but rather a partial rotation because the package tube is withdrawn from the mandrel before a complete rotation can occur.

The rotation of the gripping members may be accomplished by a small motor carried as part of the doffing apparatus.

One of the advantages of this doffing apparatus is that it can be made readily portable for use by the operator and thereby significantly reduce the amount of physical labor required by the operator in removing a package of yarn from a textile winder. The apparatus also serves to eliminate for the operator the necessity of putting his hands in an otherwise hazardous area of the winding machine. Still another advantage is that the yarn package can be removed from the textile winder and placed on a yarn truck without the operator touching the yarn, which touching could otherwise result in package and/or fiber degradation or damage or soiling.

Other advantages inherent in the nature and operation of the doffing apparatus will be apparent to those skilled in the art to which this apparatus relates.

DESCRIPTION OF THE PREFERRED EMBODIMENT

Figure 1:
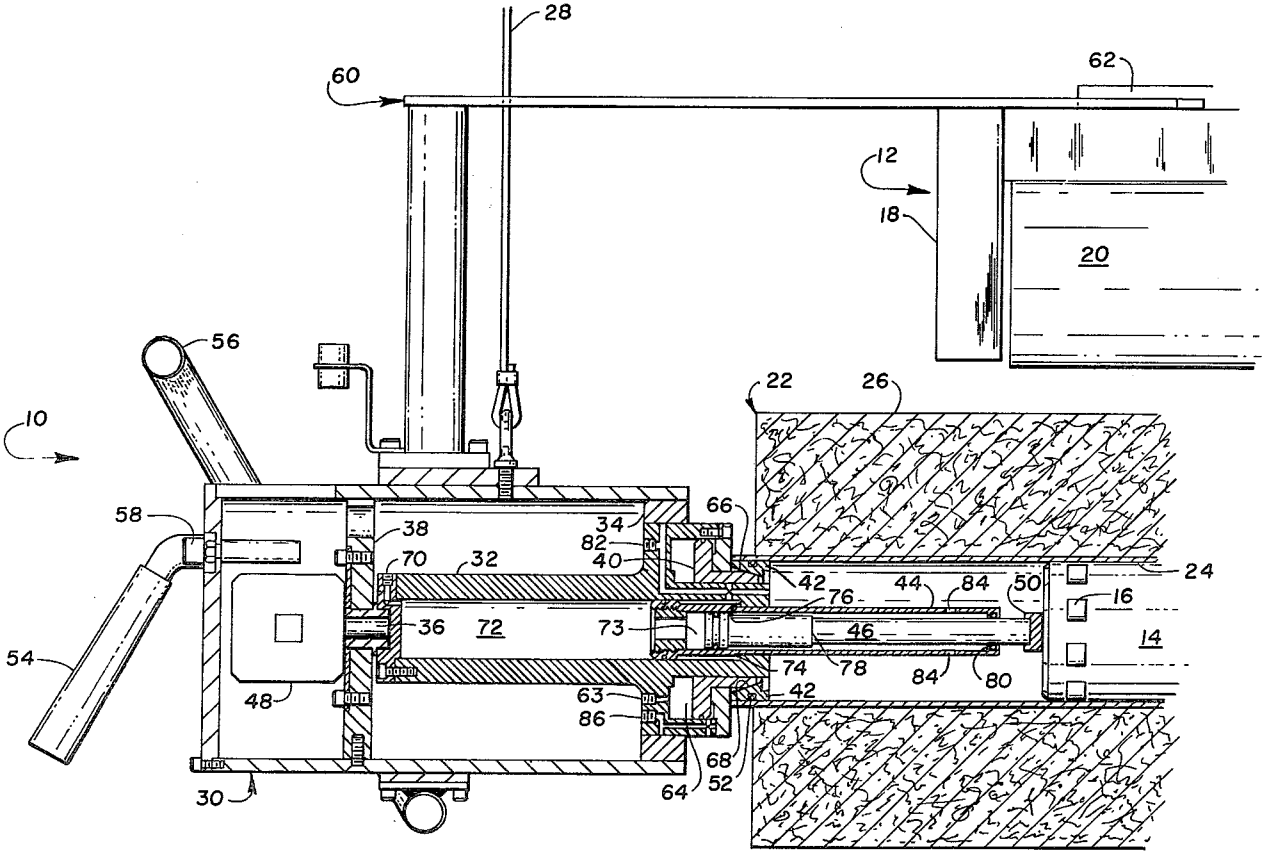
FIG. 1 is an elevation view in cross-section of the doffing apparatus and a portion of the package tube, and shows a portion of the textile winder and its winding mandrel.

In reference to FIG. 1, the doffing apparatus is shown at 10, and a porton of the textile winder is shown at 12 including an illustrated portion of the winding mandrel 14 and its spring-biased rollers 16 for rotatively locking a hollow tube, on which yarn is to be wound, on the mandrel.

Since the textile winder and its mandrel are not the subject of this invention, it will be sufficient for an understanding of the operation of the doffing apparatus to explain that the winder head 18, which carries a drive roll 20 for surface driving engagement with the package tube 22, is moved in a vertical plane on tracks (not shown) downwardly into and upwardly out of driving engagement with the package tube. The spring-biased rollers, as heretofore explained, are normally spring-biased for movement up respective ramps (not shown) to a position projecting tangentially, radially outwardly from the surface of the winding mandrel 14 through openings in the mandrel surface.

The package tube 22 comprises a hollow tube 24, which may be made of paper or the like, and the partially or fully oriented yarn 26, which is wound on the hollow tube.

Although the doffing apparatus may be portably manipulated by the operator, due to its weight and the weight of the package tube it is preferable that it be supported by an overhead hoist by means of the cable 28 in such manner that the weight of the unloaded doffing apparatus by itself is completely balanced by upward pull of the hoist (not shown). The hoist in turn may be supported on a bridge crane (not shown) to allow movement of the doffing apparatus along the length of a spinning machine (not shown) as well as in a plane perpendicular to the face of the spinning machine.

The doffing apparatus 10 comprises an outer shell or housing 30; a main cylinder 32 positioned within and rotatable relative to the outer housing by means of a fixed bearing ring 34 at one end and at the other end a shaft 36 extending through an opening in a fixed plate 38, which is connected to the outer housing and also serves as a bearing for the shaft 36; a gripper piston 40 at the outer end of the main cylinder and axially movable relative to the main cylinder; a series of four gripper members 42 radially expandable by the gripper piston for gripping a package tube; an outer piston 44 and an inner piston 46, each telescopingly movable axially of the main cylinder 32 and relative to each other; and a rotary actuator 48 drivingly connected to the shaft 36 of the main cylinder 32 for causing rotation of the main cylinder and its attendant elements.

The outer piston 44 and the inner piston 46 constitute abutment members or abutting means for initially abutting against the end of mandrel 14, and the inner piston may be provided with a bumper 50 at its outer axial end.

The gripper members 42 may be normally held radially inwardly in the retracted position by an encircling garter spring 52 seated within a groove in the outer surface of each gripper member, which garter spring also serves to force the gripper members to their retracted position when the gripper piston 40 moves to its normal retracted position. The gripper members may be knurled on their outer surfaces to enhance gripping of the outer surfaces to the package tube inside diameter.

The other elements of the doffing apparatus will be identified and their functions described in connection with the sequence of operation.

OPERATION

The doffing apparatus 10 is provided with handles 54, 56 by which the operator may manipulate the doffing apparatus, a pair of control push buttons 58 (only one push button is illustrated in the position shown in FIG. 1) located at the rear of the outer housing 30, and a guide bar 60 by which the operator aligns the doffing apparatus with the mandrel end by inserting the horizontally extending portion of the guide bar in a groove 62 existing at the top of the winder head 18.

The operator moves the doffing apparatus along the front of a spinning machine (not shown) until he reaches the position where a package tube 22 is to be doffed. The overhead hoist (not shown) is in its "unloaded" condition, meaning that it is in a well-known manner automatically, pneumatically adjusted to balance the weight of the unloaded doffing apparatus at whatever position in a vertical plane that the operator has positioned the doffing apparatus. The nature of operation of this hoist and the construction of the hoist are well-known in the art.

The operator next manipulates the doffing apparatus so as to move the guide bar 60 into the groove 62 at the top of the winder head 18 and thus align and bring the gripper members 42 and abutment members 44, 46 within the extending portion of the package tube into engagement against the mandrel end. The guide bar serves to prevent the doffing apparatus from being inadvertently brought against the end face of the wound yarn 26 on the hollow tube 24.

The operator then pushes the push button 58 (not shown) that is to his left and also left of the handle 54 and holds the button down. The gripper members 42 are caused to expand radially into gripping engagement with the inside surface of the package tube 22 by air entering the doffing apparatus through a port 63 leading into the chamber 64 rearwardly of the gripper piston 40. The air forces the gripper piston to move axially toward the gripper members, and its wedge-like annular surface 66 comes against the corresponding wedge-like surfaces 68 of the gripper members to force and move the gripper members into radial expansion.

Air then pneumatically actuates the rotary actuator 48, causing counterclockwise rotation of the main cylinder 32 and its attendant elements including the gripper members and the gripped package tube. The counterclockwise rotation of the package tube serves to free it from its rotatively locked position on the mandrel, as heretofore described.

The hoist is then automatically shifted into the loaded condition preparatory to taking the weight of the package tube as well as the weight of the doffing apparatus. The time lag between the rotation of the package tube and the shifting of the hoist into "loaded" condition is due to the time required for the air being supplied to the doffing apparatus first and then going from there through a hose (not shown) up to the hoist.

Air also goes through an air fitting 70 into the air chambers 72, 73 located rearwardly of the outer and inner pistons 44, 46, respectively, to force them axially outwardly until the stepped portion 74 on the outer piston 44 comes into abutment with the abutment portion 76, which extends radially inwardly from the main cylinder 32. The inner piston 46 continues to be moved axially relative to and beyond the outer piston until the stepped portion 78 comes into abutment with the abutment portion 80, which extends radially inwardly from the outer piston 44. Since the outer and inner pistons are already in abutment against the outer axial end of the winding mandrel 14, the telescoping outer axial movements of the two pistons serve to force the gripper members and their gripped package tube into retraction or withdrawal from the mandrel.

The sequence of steps thus far described is such that rotation of the package tube 22 occurs first to unlock the package tube from the mandrel, as previously stated, and then the rotation continues as the package tube is being withdrawn from the mandrel to continue to counteract the clockwise spring-bias action on the rollers 16 of the mandrel.

The ultimate extension of the inner piston places the package tube a few inches from being entirely withdrawn from the mandrel. The operator then completes the withdrawal movement manually. The sequence of operation to this point in description takes only a few seconds.

The operator now releases the left push button, whereupon the main cylinder is automatically rotated by the rotary actuator 48 in return to its initial position, and at the same time the outer and inner pistons return to their original positions within the main cylinder. Air enters through the air fitting 82 into the chamber 72 just rearwardly of the stepped portion 74 on the outer piston causing the outer piston to be moved axially rearwardly or inwardly of the main cylinder. When the outer piston has moved inwardly to the extent that the air openings 84 in the wall of the outer piston are within the chamber 72, air also then enters through such air openings into the chamber 73 in the area lying just rearwardly of the stepped portion 78 on the inner piston, thereby causing its retracting movement to its initial position within the main cylinder.

The operator then selects the proper peg (not shown) on a yarn truck (not shown), positions the package tube over the peg, and pushes the control push button 58 that lies to the right of the handle 54. This causes air to enter through air fitting 86 into the chamber 64 forwardly of the gripper piston 40, forcing the gripper piston into retraction and subsequent release of the gripper members 42. The gripper members are caused to retract by the tension exerted by the encircling garter spring 52, whereupon the package tube is released to seat itself into final resting position on the selected yarn truck peg.

The hoist then automatically shifts pneumatically to the unloaded condition where it balances only the weight of the unloaded doffing apparatus.

SECOND EMBODIMENT

In reference to FIG. 2 of the drawings, the elements shown in FIG. 2 that are the same as those described with reference to FIG. 1 will be identified by the same reference numbers as in FIG. 1 but will have a prime mark thereafter: such as the yarn 26' wound on the hollow tube 24', together comprise the package tube 22'. The winding mandrel is shown at 14' and its spring-biased rollers are shown at 16'.

Figure 2:
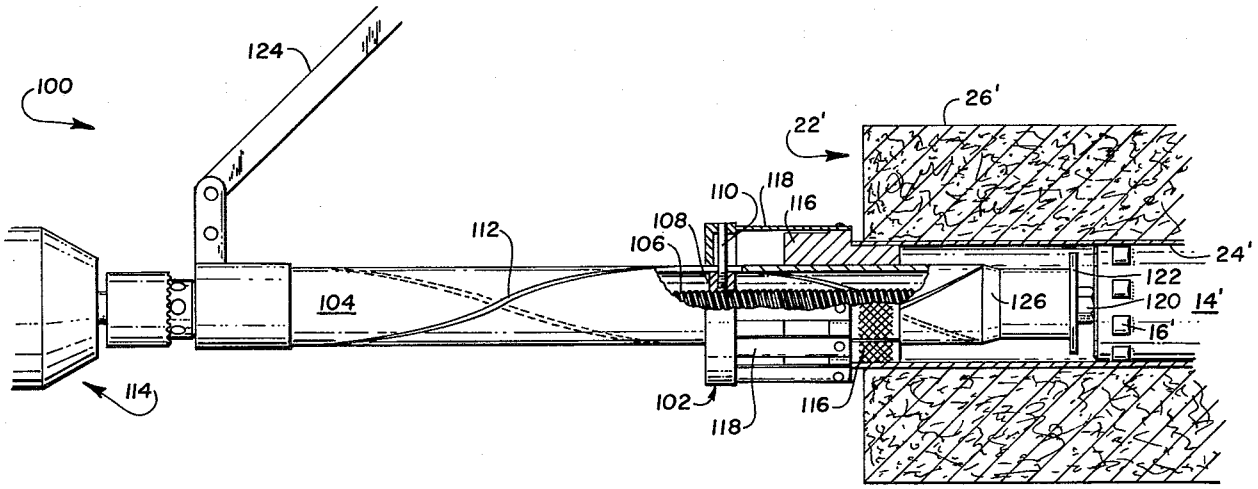
FIG. 2 is an elevation view of another embodiment of the doffing apparatus partially broken away and in cross-section and illustrating a portion of the package tube in cross-section and a portion of the winding mandrel of a textile winder.

A second embodiment of a doffing apparatus is shown at 100 in FIG. 2. The second embodiment comprises a tube gripping mechanism 102, which is axially and rotatively movable in a helical path along a support shaft 104 by the agency of a revolvable screw shaft 106; a threaded nut 108, which is drivenly interengaged with the threads of the screw shaft and in turn is connected to the tube gripping mechanism through a pair of opposed pin guides 110 (only one pin guide is shown in the drawing) that extend through the illustrated helical slot 112 in the support shaft 104; and a drive mechanism 114 (which is only partially illustrated), which serves to drive in rotation the screw shaft 106.

The tube gripping mechanism 102 includes a series of four gripper members 116, the outer surfaces of which may be knurled, as shown, and which may be slidingly or preferably rollably (the rollers are not illustrated) engaged with the surface of the support shaft 104 and are each connected to a spring finger 118 that urges the respective gripper member into engagement with the support shaft.

The distal end of the support shaft 104 constitutes an abutment member or abutting means 120 to be positioned against the end of the winding mandrel 14', and adjacent to the abutment member is a guide member 122 for guiding the doffing apparatus into the exposed end portion of the package tube 22'.

The other elements of the doffing apparatus of the second embodiment will be identified and their functions described in connection with the sequence of operation.

OPERATION

The doffing apparatus 100 of the second embodiment is provided with a handle 124 (only partially shown in FIG. 2) located forwardly of the drive mechanism 114 and a handle (not shown) rearwardly of the drive mechanism by which the operator may manipulate the doffing apparatus. A control button (not shown) is provided on the drive mechanism for actuating rotation of the drive mechanism and the attached revolvable screw shaft 106, and a reversing switch (not shown) is also provided on the drive mechanism for reversing the drive of the drive mechanism.

The doffing apparatus may similarly be connected to an overhead hoist and crane arrangement (not shown) by means of a cable (not shown) as in the embodiment shown in FIG. 1. The operator moves the doffing apparatus along the front of a spinning machine (not shown) until he reaches the position where a package 22' is to be doffed. He then manipulates the doffing apparatus so as to guide the distal end of the doffing apparatus, including the abutment member 120, guide member 122 and gripper members 116 into the extending portion of the package tube until the abutment member abuts against the end of the winding mandrel 14'.

Prior to this manipulation operation, the operator has caused the tube gripping mechanism 102 to be moved to the distal end of the support shaft 104 where the gripper members 116 have been spring-biased to move radially inwardly, preparatory for gripping the inside diameter of the package tube, after riding down the reduced stepped portion 126 on the support shaft 104.

The operator then reverses the drive of the drive mechanism 114, and as the tube gripping mechanism 102 moves back along the support shaft 104, the gripper members 116 ride up from the stepped portion 126 on the support shaft to grip the inside diameter of the package tube. The tube gripping mechanism continues to retract along the support shaft, bringing with it the gripped package tube 22' and revolving as it moves axially along the support shaft. The revolving motion serves to free the package tube from its locked position on the winding mandrel, as explained with reference to the embodiment of FIG. 1. The support shaft thus remains stationary with the abutment member 120 abutting the end of the winding mandrel.

Once the package tube has been completely withdrawn from the mandrel, the operator removes the doffing apparatus from the mandrel and selects the proper peg (not shown) on a yarn truck (not shown) and positions the package tube over the peg. He then again reverses the drive mechanism, causing the tube gripping mechanism to move with its gripper package tube toward the distal end of the support shaft until the gripper members ride down the stepped portion 126, thereby releasing the package tube from the grip of the gripper members.

The invention has been described in detail with particular reference to preferred embodiments thereof, but it will be understood that variations and modifications can be effected within the spirit and scope of the invention.

We claim:

1. Apparatus for doffing a yarn package from a winder, the yarn being wound on a hollow tube, the hollow tube in turn being mounted on a winding mandrel of the winder, rotatively locked thereon and having an end portion of the tube extending axially outwardly of the end of the winding mandrel, the apparatus comprising:

gripping means adapted for being inserted within the outwardly extending portion of the hollow tube and being actuatable for expanding radially outwardly into gripping engagement with the inside surface of the tube end portion;

means for rotating the gripping means and the hollow tube it is gripping relative to the winding mandrel to release the yarn package from its rotatively locked position on the winding mandrel;

means actuatable for withdrawing the gripping means and the yarn package it is gripping from the winding mandrel; and means for actuating in succession, respectively, the gripping means, the rotating means and the withdrawing means.

2. Apparatus for removing a package tube carrying material wound thereon from a mandrel over which the package tube is positioned and locked thereto and has an open end extending axially beyond the mandrel end, said apparatus comprising:

abutting means adapted to be axially aligned with the end of the mandrel and to be placed in abutment against the mandrel end, gripping means concentric with the abutting means for engaging within the open end of the package tube and gripping the inside surface of the package tube, means for rotating the gripping means and the package tube after the gripping means has engaged and gripped the package tube and by such rotation release the package tube from its locked position on the mandrel, and means for moving in an axial linear direction one of the abutting means and the gripping means relative to the other for withdrawing the package tube from the mandrel as the package tube is being rotated.

3. Apparatus as defined in claim 2, wherein the abutting means upon abutment against the mandrel end remains stationary, and upon the gripping means engaging and gripping the package tube said means for moving one of the abutting means and the gripping means moves the gripping means axially linearly relative to the abutting means and the mandrel end to cause withdrawal of the package tube from the mandrel.

4. Apparatus as defined in claim 2, wherein said means for moving one of the abutting means and the gripping means moves the abutting means axially linearly relative to and away from the gripping means into abutment with the mandrel end and continues to move telescopingly beyond the gripping means and thereby causes the remainder of the apparatus including the gripping means and the package tube to which the gripping means is gripped to be moved axially linearly in a direction opposite to the movement of the abutting means.

5. Apparatus as defined in claim 2, and further comprising:

an outer housing;

a main cylinder positioned within and rotatable relative to the outer housing, the main cylinder including therewithin the gripping means and the abutting means; and drive means connected to the outer housing and to the main cylinder for driving the main cylinder in rotation upon actuation of the drive means.

* * * * *